US006474029B1

(12) United States Patent
Cook et al.

(10) Patent No.: US 6,474,029 B1
(45) Date of Patent: Nov. 5, 2002

(54) ROADWAY, HARDSTAND, FLOOR OR FENCE/WALL

(75) Inventors: Peter Cook, Trowell; Gordon Partridge, Cropwell Bishop; Anthony Richard Marsh, West Bridgford, all of (GB)

(73) Assignee: L. H. Woodhouse & Co. Ltd. (GB)

( * ) Notice: Subject to any disclaimer, the term of this patent is extended or adjusted under 35 U.S.C. 154(b) by 0 days.

(21) Appl. No.: 09/412,743

(22) Filed: Oct. 5, 1999

(30) Foreign Application Priority Data

Oct. 6, 1998 (GB) ..... 9821607

(51) Int. Cl.[7] ..... E04C 3/20
(52) U.S. Cl. ..... 52/223.7; 52/586.1
(58) Field of Search ..... 52/223.7, 223.1, 52/586.1

(56) References Cited

U.S. PATENT DOCUMENTS 849,917 A * 4/1907 McLean ..... 52/40
4,488,833 A * 12/1984 Perry et al. ..... 52/586
4,681,482 A 7/1987 Arciszewski et al. ..... 404/35

FOREIGN PATENT DOCUMENTS

GB 2 199 864 A 7/1988 ..... E01C/5/00
GB 2 273 117 A 6/1994 ..... E02D/29/02

OTHER PUBLICATIONS

Search Report of Application No. GB 9923388.4 by Examiner Lyndon Ellis dated Feb. 16, 2000, referencing above–cited references.

* cited by examiner

*Primary Examiner*—Lanna Mai
*Assistant Examiner*—Jerry A. Anderson
(74) *Attorney, Agent, or Firm*—George T. Marcou; Kilpatrick Stockton LLP

(57) ABSTRACT

A roadway or fence comprises a series of panels linked together by means of flexible joints. A series of the panels is prevented from separating into discrete panels by means of a compression rod. Lengths of the panels thus connected are secured to further such lengths using a coupling device.

12 Claims, 7 Drawing Sheets

ROADWAY, HARDSTAND, FLOOR OR FENCE/WALL

This invention relates to a roadway, hardstand, floor or fence/wall (referred to herein as a panel construction), especially but not exclusively such a panel construction built as a temporary structure at e.g. indoor and outdoor events such as sporting events; concerts; agricultural shows; equestrian events; and festivals.

There is a long recognised need for e.g. fences and pedestrian and vehicular roadways, at such events, that may be delivered from a remote location; rapidly assembled and laid; and easily removed when no longer required.

Traditionally such panel constructions have been formed by linking together a series of panels to define a roadway or fence. Known panels comprise a series of timber boards side by side and banded with pairs of parallel, metal straps to define each panel. The metal straps are pinned or bolted to the boards. They may be linked together to connect series of the panels together.

The known panels are portable and are generally robust, but they suffer numerous disadvantages. Probably the most serious is that they are heavy in order to provide robustness. The panels are prone to breakages. Therefore they are awkward and occasionally dangerous to handle and lay. Also their weight limits the number of them that may be transported on a lorry, thereby increasing the transportation costs associated with the known designs.

A further disadvantage of the banded timber panels is that they are awkward to repair, since the metal banding usually must be unpinned and removed before any of the boards can be replaced.

Yet a further problem is that if the banding becomes damaged it can puncture vehicle tires or injure pedestrian users.

An alternative to the banded timber panels is known from GB-A-2 199 864, in which a series of narrow (approximately 460 mm (18") wide), discrete, rigid panels is secured together side by side by pairs of rigid, elongate, threaded bolts received in aligned, through-going bores in the panels. Spigots extending from each panel are received in recesses in the adjacent panel. Tightening of the bolts and the use of the spigots jointly contribute to the rigidity of the lengths of roadway shown in GB-A-2 199 864.

The arrangement of GB-A-2 199 864 also suffers some disadvantages, as follows:

(i) the need to tighten the bolts to rigidify lengths of the panels is time consuming during assembly of the panels;

(ii) the rigidity of lengths of roadway made in accordance with GB-A-2 199 864 means that the roadway cannot easily conform to undulations on the ground on which it is laid. When the panels of GB-A-2 199 864 are used in an upright orientation, as fence panels, a similar problem arises;

(iii) the elongate bolts arc each made up from a series of sub-lengths that must be screwed together on site during assembly of the roadway. This is time consuming to achieve;

(iv) the requirement for rigidity of a roadway made from the panels of GB-A-2 199 864 means that the panels must be inherently heavy. Therefore the length of each panel is limited in order to permit its handling. Consequently it is time consuming to assemble such a large number of panels into a long roadway. One advantage of a first aspect of the invention is that it permits a panel construction to be flexible when assembled. This in turn allows the ground or other surface supporting the panel construction to provide a significant part of its load bearing capability.

The use of a rigid compression member primarily to prevent separation of the panels from one another (and not primarily to rigidify a series of the panels) assists in providing flexibility. It also permits the compressing member to be a predetermined length, corresponding to a known plurality of the panels lying side by side, thereby eliminating the need individually to assemble the rods of GB-A-2 199 864.

Preferably the panel construction includes at least one rigid or flexible compression strip. In preferred embodiments the strip is in the for construction. According to a second aspect of the invention there is provided a panel construction that omits the rigid compression rod defined hereinabove.

In all embodiments an advantage of the projections is that they can be shaped during manufacture of the panels to provide a liquid dispelling seal when the panels are assembled together. This can assist in providing buoyancy which in turn assists the apparatus of the invention to support loads, especially (but not exclusively) on wet or muddy ground.

The use of a rigid reinforcing rod and (optionally or alternatively) a rigid or flexible reinforcing strip, primarily to prevent separation of the panels from one another, (and not primarily to rigidify a series of panels) assists in providing flexibility. The rigid reinforcing rod and the rigid or flexible reinforcing strip may each be a predetermined length, corresponding to a known plurality of panels lying side by side, thereby eliminating the need individually to assemble the rods of GB-A-2 199 864.

An advantage of this arrangement is that it provides a construction that exhibits an improved resistance to buckling/concertinaing and twisting of the panels when formed as e.g. single or multiple tracks when subject to heavyweight vehicles and vehicles with twin axles and differential drive trains and braking.

Various optional, advantageous features of the invention are defined in the dependent claims.

There now follow descriptions of preferred embodiments of the invention, by way of non-limiting example, with reference being made to the accompanying drawings in which.

Figure 15A:
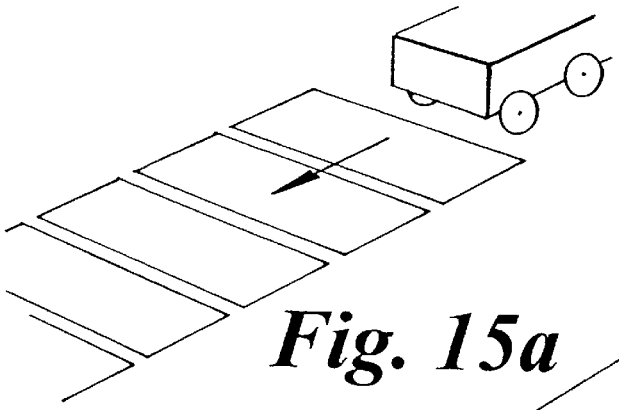
Figure 15B:
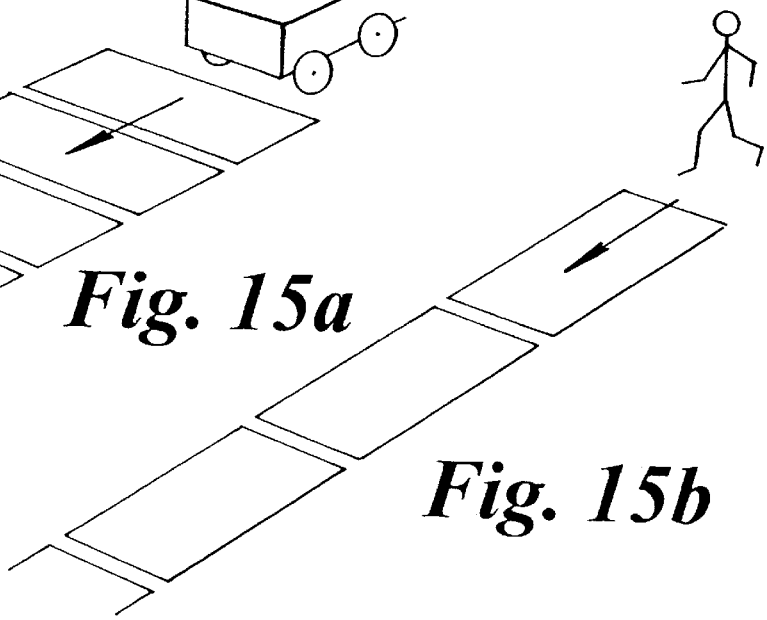

FIGS. 15*a* and 15*b* show perspective views of two different configurations of an embodiment of a panel construction according to the invention.

Figure 16:
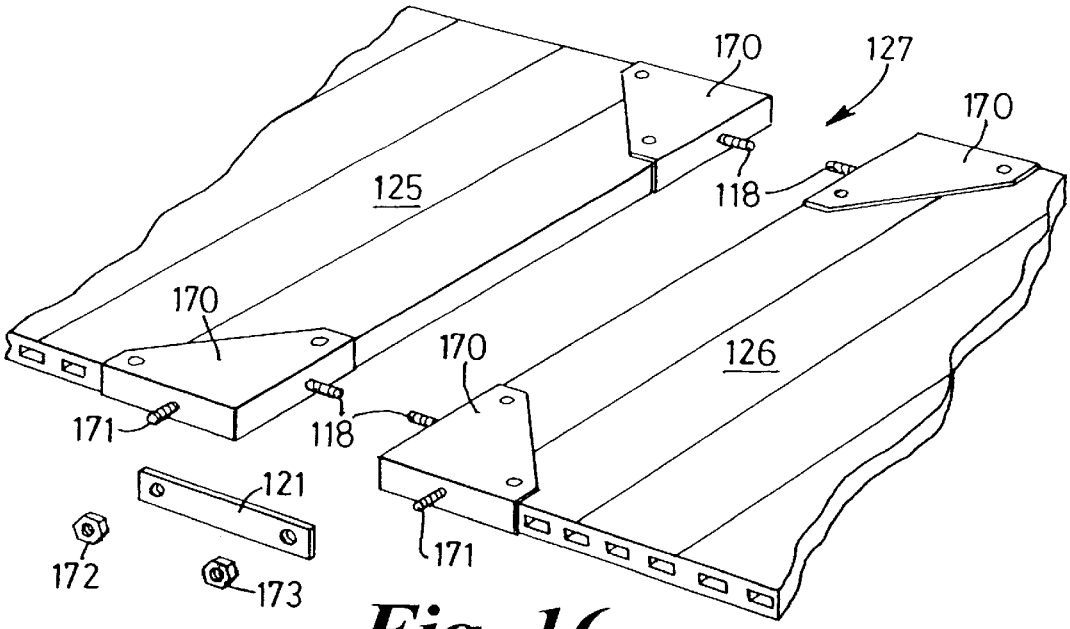

FIG. 16 shows a further coupling with brackets and an elongated plate across the side edges of the joint.

Figure 17:
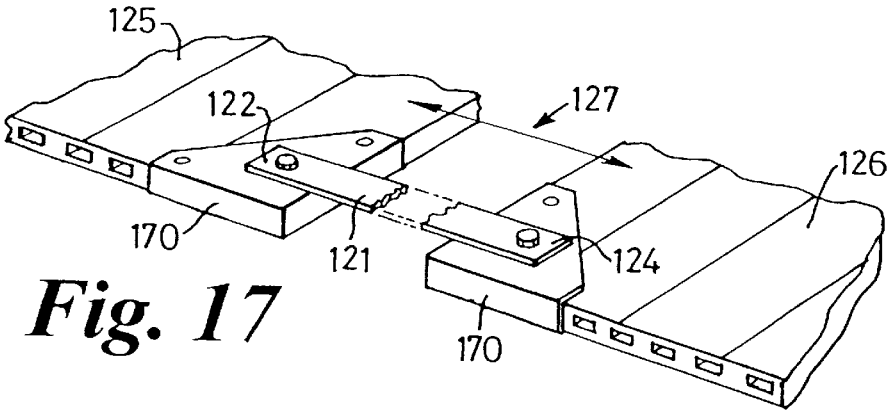

FIG. 17 shows a further coupling with the corner brackets and an elongated plate.

Figure 18:
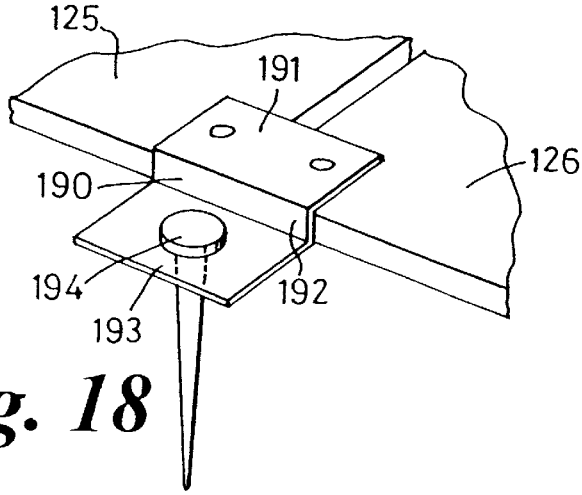

FIG. 18 shows a further coupling with a ground engaging spike.

Figure 1:
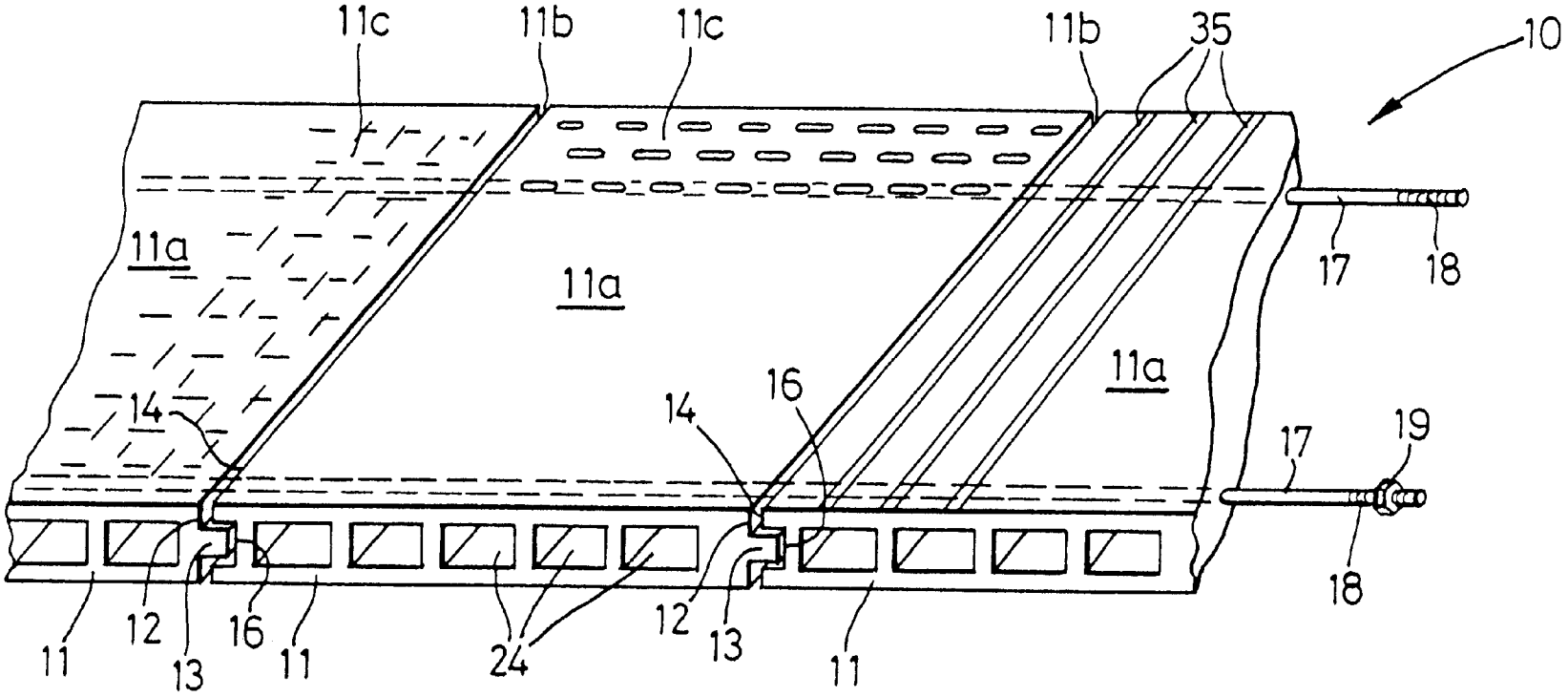
FIG. 1 is a perspective view of an embodiment of a panel construction according to the invention.

In FIG. 1, a panel construction 10 according to the invention comprises a plurality of planar panels 11 linked together to define a substantially continuous surface 11*a*, having only small gaps 11*b* between adjacent panels 11.

One side edge 12 of each panel 11 has protruding therefrom substantially along its entire length an elongate protrusion 13. The major dimension of protrusion 13 is generally parallel to the plane of surface 11*a* in the embodiment shown, although this need not be necessarily so.

A side edge 14 of each panel 11 includes a recess 16 of complementary shape to the protrusion 13, for receiving the protrusion 13 when two or more of the panels 11 are compressed into a generally abutting relationship. The dimensions of the protrusion 13 and recess 16 are such that two adjacent, abutting panels 11 may flex or tilt relative to one another when the protrusion 13 is received in an adjacent recess 16.

The protrusion 13 and recess 16 define a joint that is substantially liquid proof, thereby preventing seepage or flow upwards through the panel construction 10 when it lies on e.g. wet ground. As indicated this improves the buoyancy of the construction.

The gaps 11*b* extend transversely of the rectangular panel construction 10 shown, although of course panels 11 of other shapes would give rise to gaps 11*b* in other pattern.

In the embodiment shown, each panel 11 is rectangular or square, although other regular or irregular shapes may be used. In preferred embodiments each panel 11 is less than 50 mm deep, and most preferably approximately 25 mm deep, thereby defining side edges of the panels 11. Preferably the panels 11 are between 1.2 m and 3 m long. Typically each panel 11 is less than. 300 m wide, and preferably about 140 mm wide. In typical installations sets of panels 11 may be joined together, as described above, to create unitary lengths of the panels 11 of up to 1.2 m to 3 m long, although longer and shorter unitary lengths can be made if desired.

It will readily occur to a skilled reader how, within the scope of the invention, to modify the protrusion 13 and recess 16 to permit flexible linking of panels 11 of non-rectangular shapes.

A series of the panels 11 linked together to form a unitary length of panel construction 10 is prevented from separating into a plurality of discrete panels 11 by means of a rigid compression member in the form of an elongate metal rod 17 threaded (18) at either end and received in mutually aligned, through-going bores extending through the panels 11 in the elongate direction of the panel construction 10. A nut 19 may be screwed onto each threaded end 18 of the rod 17 to prevent separation of the unitary length of panels 11.

Figure 4:
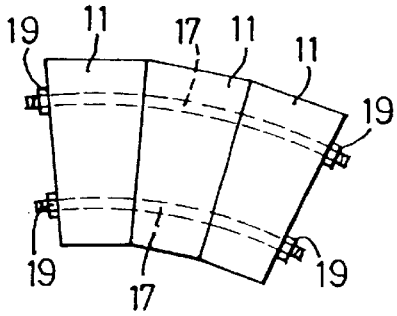
FIG. 4 shows a curved panel construction according to the invention.

In an alternative arrangement not forming part of the invention as claimed, such a compression member may be a flexible member such as a cable, a metal or textile ribbon or rope. This permits arrangements such as that shown in FIG. 4, in which sector-shaped panels 11 are linked by a flexible (or curved) member 17 to define a curved panel construction unit.

An important point is that the compression member serves primarily to prevent separation of the panels 11, and not to rigidify completely the unitary lengths 10. It will readily occur to those skilled in the art how to arrange the rigid or substantially rigid rod 17 and the panels 11 so that the joints defined by the protrusions 13 and recesses 16 may flex.

The rod 17 need not be threaded at both ends. One of the ends may include a flange, a clip or another retention device that, with) a nut 19 at the other end of the rod 17, serves to prevent separation of the individual panels 11 from one another.

Figure 2:
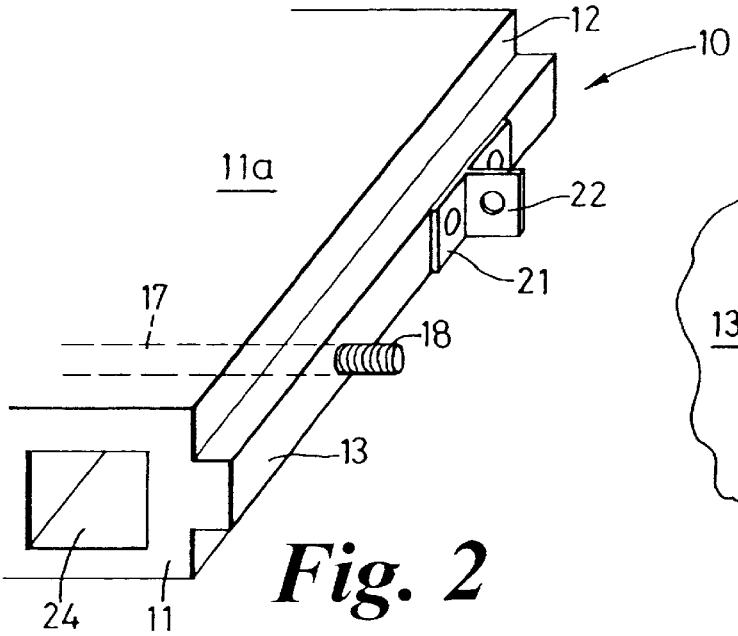
FIG. 2 is a perspective view of part of the FIG. 1 arrangement, more detail.

As shown in FIG. 2, preferably there is a plurality of the elongate rods 17 in each unitary length. An important feature of the invention is that none of the elongate rods performs a complete rigidifying function.

Also in preferred embodiments the elongate rods 17 are all of the same length, corresponding to a unitary length of panel construction 10 equivalent to the length of, say, 9 of the panels 11, so that the number of nuts 19 requiring threading and tightening is kept to a minimum compared with the arrangement in GB-A-2 199 864, in which the rigid rods must be assembled to a required panel construction length.

The above mentioned features ensure that the panel construction 10 is quick to assemble on site.

Figure 3:
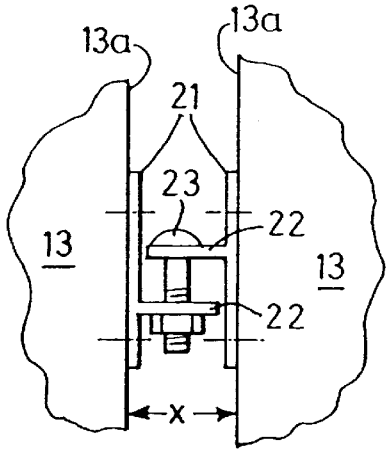
FIG. 3 shows an embodiment of a coupling mechanism forming part of the invention.

Once a unitary length of the panel construction 10 is assembled, it may be flexibly secured to an adjacent panel or unitary length using e.g. the offset hasp arrangement shown in FIGS. 2 and 3; or e.g. the rod eye arrangement of FIG. 5.

In FIGS. 2 and 3 a plate 21 e.g. of steel is secured e.g. by bolting onto the upright side edge 13*a* of protrusion 13. Plate 21 has upstanding therefrom a hasp plate 22 having a through-going bore. Hasp plate 22 is offset relative to the center line of plate 21 so that it may lie adjacent a further such hasp plate, offset to the opposite side of the aforesaid center line, upstanding relative to a further plate 21 secured to a further panel or unitary length. When thus arranged the through-going bores of the two hasp plates 22 are aligned for receiving a nut and bolt 23 (or similar fastening) that permits pivotable linking of the unitary length and the further panel together. Thus lengths of the panel construction of the invention may rapidly be pivotably linked together. The gap x between the adjacent protrusions 13 may if desired be closed by a filler piece.

Figure 5A:
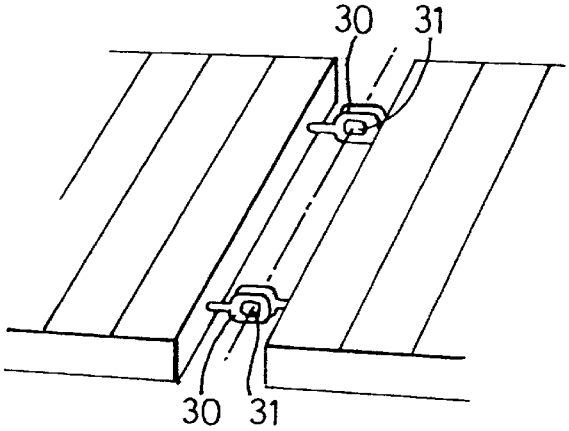
FIG. 5 shows an alternative coupling.
Figure 5B:
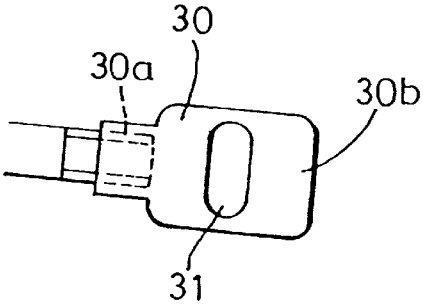

FIGS. 5*a* and 5*b* show an alternative arrangement, in which a rod end 30 having a threaded recess 30*a* is screwed onto the end of each rod 17.

Each rod end 30 includes a plate 30*b* having formed therein an eye 31. If, as shown in FIG. 5*a*, the locations of the rods 17 are offset relative to one another in the transverse direction, the respective eyes 31 may in use of the panel construction be mutually aligned for receiving a bolt or other fastening.

As an alternative to a bolt, an elongate pin 32 (FIG. 6) may be used for pinning the unitary lengths of the connected panels together.

Figure 6:
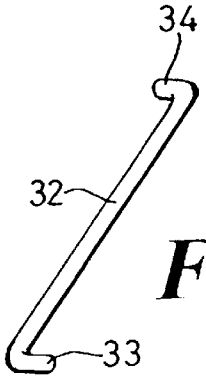
FIG. 6 shows a preferred coupling pin.

The embodiment of the pin 32 shown in FIG. 6 includes a crank 33,34 at each end. The respective cranks extend in mutually different directions (opposite directions in the embodiment shown, although the cranks need not be parallel). Thus if the eyes 31 of the rod ends 30, or the bores of the hasp plates 22 are of an elongate form, or at least have an elongate portion, it is possible to insert the pin 32, in one orientation, into the eyes/bores (as indicated by the chain line in FIG. 5*a*); and subsequently rotate it to a further orientation in which the cranks 33,34 prevent the pin 32 from working out of the eyes/bores.

Numerous designs of the eyes 31 and the retaining feature exemplified by cranks 33 and 34 arc within the scope of the invention.

The elongate or otherwise shaped aperture exemplified by eye 31 may be employed in a range of possible apparatuses for securing the unitary lengths together.

The panels 11 are preferably extruded from a plastics material such as PVC. Recycled PVC has been found to offer good lightness and durability.

The lightness of the panels is further improved by the extruded panels 11 each having formed therein one or more hollow recesses 24. In preferred embodiments the hollow recesses are formed during the extrusion process, and hence are through-going. This allows drainage of water or other fluids front the panels 11 following use in wet environments. More importantly, when lengths of the panel constructions shown in FIG. 1 are rotated through 90° to define a series of upright fence panels, the fence may be staked to the ground via e.g. the hasps 22 or eyes 31. Alternatively supporting stakes may engage with or pass through some of all of the recesses 24.

The recesses 24 may be sealed against ingress of fluids (e.g. by using suitable bungs; or by plugging with a formable material such as mud or a resilient polymer) thereby increasing the flotation of a roadway made from the panels 11. This is especially useful when the roadway is to be used on muddy, wet or marshy ground.

As shown in FIG. 1 the surfaces 11*a* of the panels 11 may have a variety of finishes such as the non-slip finish 11*c* shown, which may be regular or irregular; or a smooth finish. A preferred, but not essential, finish is that visible at 35 in FIG. 1, in which grip ridges are extruded in the transverse direction of the panels, during manufacture.

The lightness of the panels 11 means that a large number of them can be carried to a site on a conventional lorry trailer. The panel construction 10 is then created by threading the elongate rods 17 through the panels 11, and applying the nuts 19, as necessary, to the elongate rods 17 to define the unitary, flexible lengths previously mentioned. The completed panels 11 are then lain (quickly) on the ground and connected together or staked in position as fencing, and subsequently connected to further such unitary lengths using the arrangement of FIG. 3 or 5.

Figure 7:
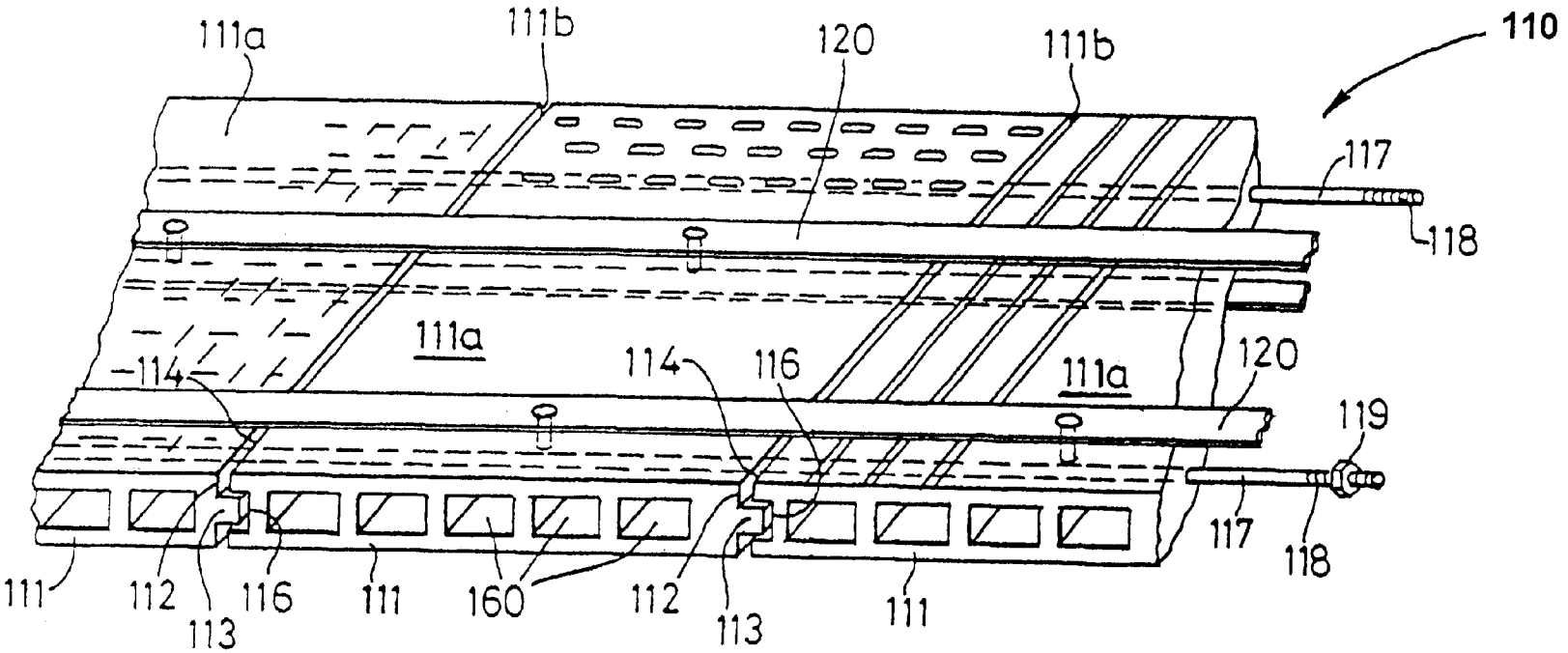
FIG. 7 is a perspective view of an embodiment of a panel construction according to the invention.

FIG. 7 shows a panel construction 110 according to a further embodiment of the invention. As in the panel construction 10 shown in FIG. 1, the panel construction 110 shown in FIG. 7 comprises a plurality of planar panels 111 linked together to form a substantially continuous surface 111*a*.

The planar panels 111 are provided with a regular or an irregular finish, thereby in use providing the continuous surface 111*a* with a finish that reduces slipping on the panel construction 110.

The panels 111 are rectangular and may have substantially the same dimensions as the panels 11 described in connection with the panel construction 10 shown in FIG. 1.

In the FIG. 7 embodiment, the panels 111 are each provided with a protrusion 113 and a complementary shaped recess 116 on opposite side edges 112 and 114 respectively. The protrusions 113 and recesses 116 are substantially the same as the protrusions 13 and recesses 16 of the panels 11.

A series of panels 111 are linked together to form a unitary length of the panel construction 110. The panels 111 are prevented from separating into a plurality of discrete panels by a rigid compression member in the form of an elongate metal rod 117 and a rigid or flexible external compression strip in the form of an elongate strip 120. The elongate metal rod 117 is threaded 118 at either end, and is received in mutually aligned, through-going bores extending through the panels 111 so that the elongate metal rod 117 passes through each of the panels 111 in the unitary length. A nut 119 may be screwed on to each threaded end 118 of the elongate metal rod 117 to secure the panels 111 of the unitary length together.

The elongate metal rod 117 need not be threaded at both ends. One of the ends may be provided with a flange, a clip or any other retention device that, with a nut 119 on the other end of the elongate rod 117, serves to prevent separation of the individual panels 111.

The elongate strip 120 is secured to the substantially continuous surface 111*a* of the unitary length so that it extends generally parallel to the elongate metal rod 117.

Preferably each unitary length of the panel construction 110 includes a plurality of elongate metal rods 117 and elongate strips 120 The elongate strips 120 preferably extend along both the substantially continuous surface 111*a* and the opposite underside 111*a*' of the unitary length.

The elongate strips 120 may take the form of steel bands that are secured by e.g. bolts or pins to eg. every second panel 111 in the unitary length. As with the embodiment shown in FIG. 1, an important feature of the invention is that the elongate metal rods 117 and elongate strips 120 do not perform a complete rigidifying function.

In preferred embodiments of the invention, the elongate metal rods 117 and elongate strips 120 are all approximately the same length, corresponding to a unitary length of the panel construction 110 equivalent to the length of, say, 9 of the panels 111. As with the previously described embodiment, this reduces the number of bolts 119 that require threading and tightening.

Figure 8:
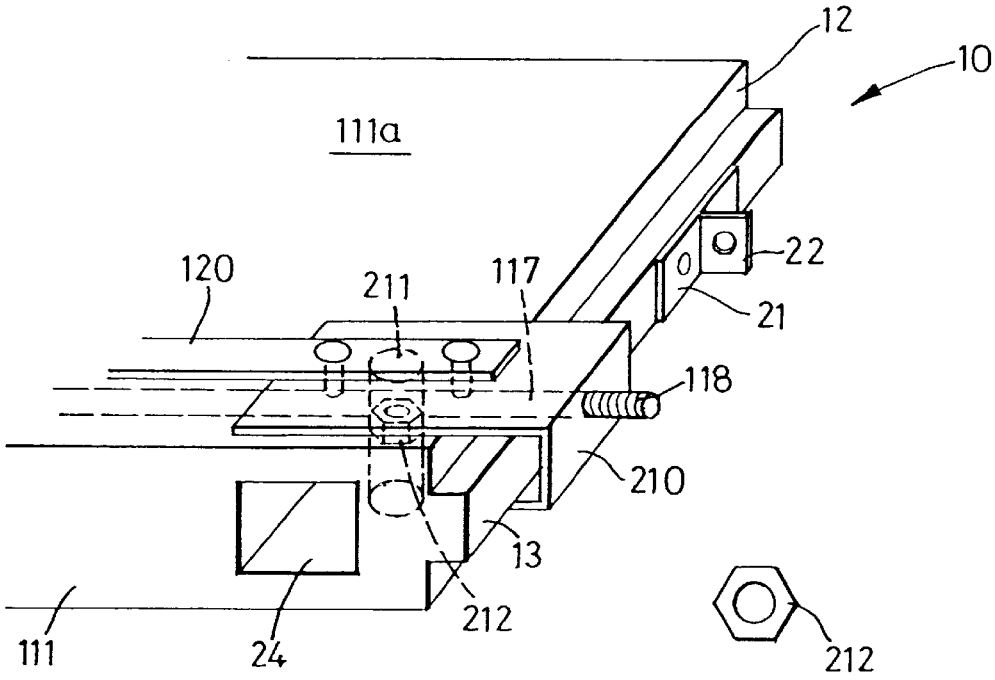
FIG. 8 is a perspective view of part of a unitary length of an embodiment of a panel construction according to the invention.

FIGS. 7 and 8 show one way of terminating each unitary length. As shown each compression strip or band 120 extends along the unitary is length "inboard" of the rod 117. Between the rod 117 and strip 120 the end panel member 11 includes a through-going bore 211 having a nut secured therein against rotation. A n-shaped plate 210 extends about the free end of panel 11. Strip 120 is pinned or bolted through plate 210 to secure it relative to the unitary length.

The threaded end 118 of rod 117 protrudes through plate 210 at the free end of the unitary construction. A tensioning nut screwed onto end 118 thus thrusts against plate 210, movement of which relative to panel 11 is prevented by the pinning of the strip 120. Thus even on tightening of the nut the compressive force applied to the panels 11 of the unitary length is limited to that necessary to prevent separation. Rigidifying does not occur.

The nut 212 (FIG. 8) welded or otherwise secured in aperture 211 permits use of a connection assembly such as that show in FIG. 12 (described below), once the unitary lengths are assembled. The bolts of FIG. 12 may be threadedly engaged with the nut 212 to secure plate 121.

Once a unitary length of the panel construction 110 is assembled it may be secured to an adjacent panel or unitary length by one of the coupling assemblies shown in FIGS. 2, 3, 5 (all described hereinabove) 9, 12, 13 and 16 to 18 (described hereinbelow).

Each of the coupling assemblies of FIGS. 9, 12, 13 and 17 includes an elongate plate member 121 provided with an aperture formed at either end 122,124

Figure 9:
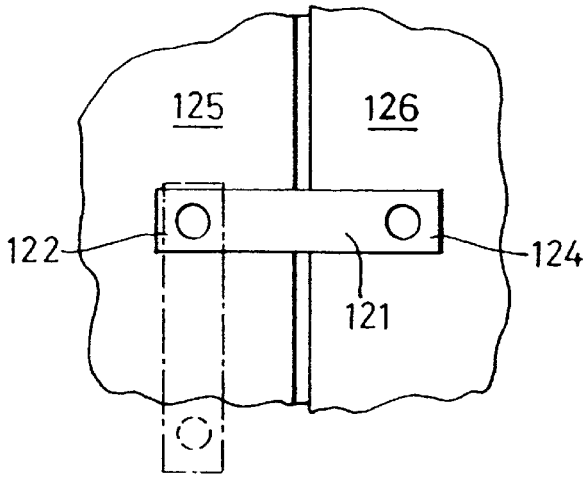
FIG. 9 is a plan view of part of an embodiment of a panel construction according to the invention.
Figure 10:
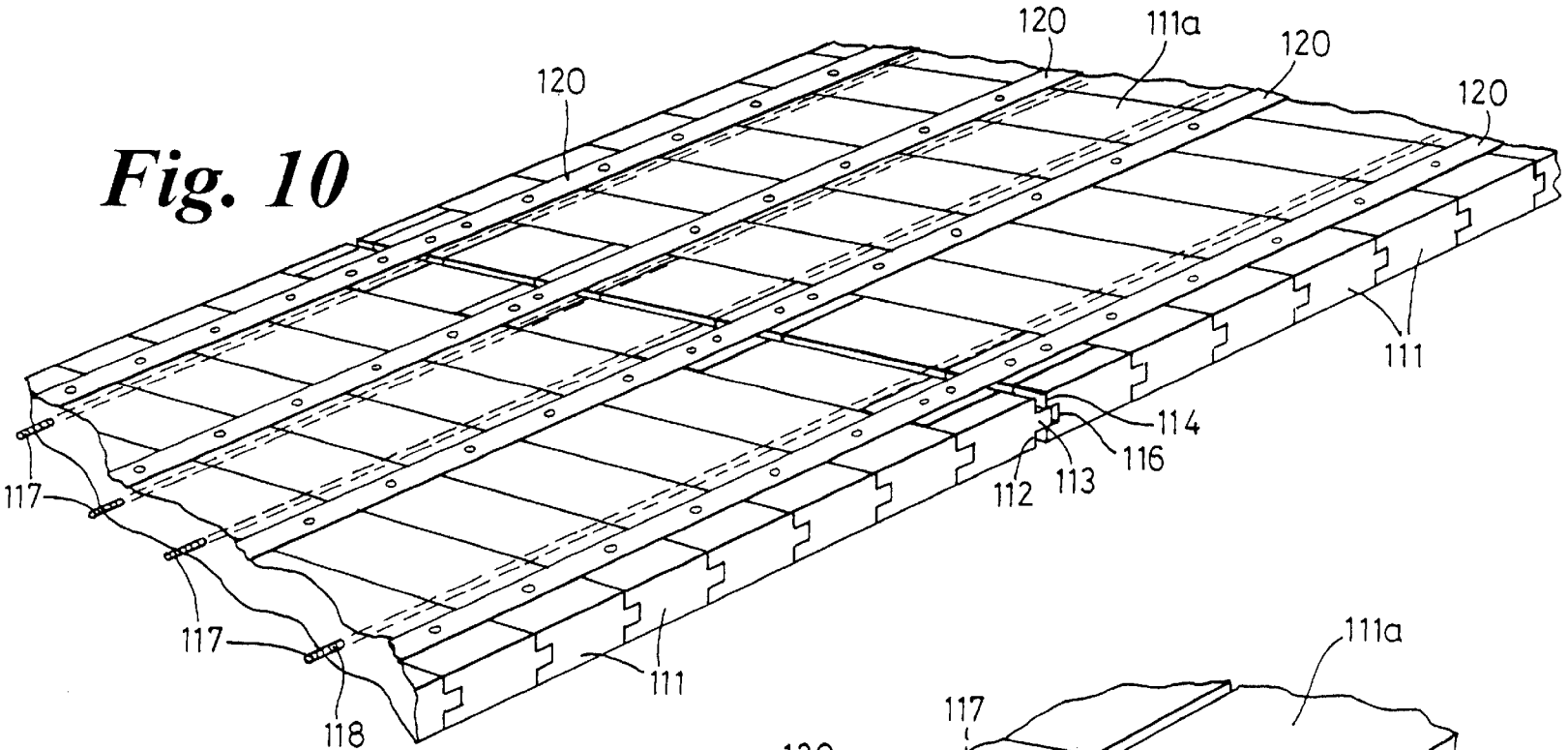
FIG. 10 is a perspective view of an embodiment of a panel construction according to the invention.
Figure 11:
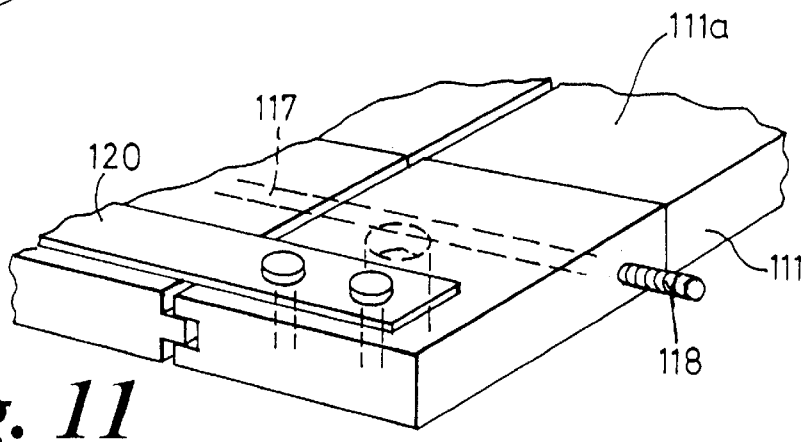
FIG. 11 is a perspective view of part of an embodiment of a panel construction according to the invention.
Figure 12:
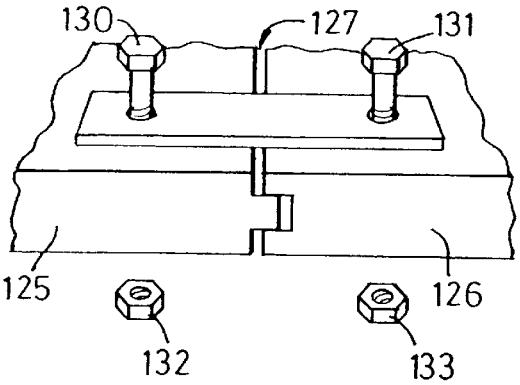
FIG. 12 is an embodiment of a coupling mechanism forming part of the invention.

In FIGS. 9 and 12, in use a first end 122 of the plate member 121 is secured to the substantially continuous surface 111*a* of a first unitary length 125. The second end 124 of the plate member 121 is secured to the surface 111*a* of an adjacent panel or unitary length 126. Thus the plate 121 extends across, and perpendicular to, the joint 127 between the two unitary lengths 125,126 of the panel construction 110.

The plate 121 is secured to each of two unitary lengths 125,126 of the panel construction 110 by two threaded bolts 130,131 Each of the threaded bolts 130,131 passes from the underside of one of the unitary lengths 125,126, through through-going bores in the unitary lengths 125,126, so that the threaded ends of the bolts 130,131 protrude through the substantially continuous surfaces 111*a* of each of the unitary lengths 125,126.

The plate 121 is positioned over die joint 127 between the two unitary lengths 125,126 so that the threaded ends of the bolts 130,131 also protrude through the apertures in the plate 121. The plate 121 is then secured in position by threading nuts 132,133 onto the threaded ends of the bolts 130,131.

Figure 13:
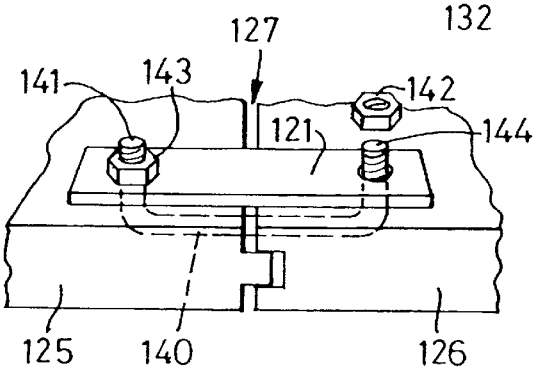
FIG. 13 shows a further coupling.

In the coupling assembly shown in FIG. 13, the plate 121 is secured, to each of the two unitary lengths 125,126 of the panel construction 110 by a U-shaped bolt 140. Each end of the U-shaped bolt 140 can be passed through one of the apertures in the plate 121 and into a through-going bore in one (126) of the two unitary lengths of the panel construction 110.

The undersides of the abutting end panels of the unitary lengths 125, 126 may include recesses for receiving the shank of the U-shaped bolt, thereby allowing flush undersides of the panel construction ends.

When the plate 121 is positioned over the joint 127 the ends 143, 144 of the U-bolt 140 protrude through the apertures in the plate 121 that can be secured in place by threading nuts 141, 142 onto threaded ends 143, 144

In FIG. 17 corner brackets 170 are provided that envelop the corners of the adjacent unitary lengths 125,126. These corner brackets 170 are triangular in FIG. 17, but they may be square or any other suitable shape.

The plate 121 is secured to each of the two unitary lengths 125,126 of the panel construction 110 by either threaded bolts 130,131 or a threaded U-shaped bolt 140. As in FIGS. 9, 12 and 13 the threaded bolts 130,131 or the threaded U-shaped bolt 140 are inserted in through-going bores extending through the unitary lengths 125,126, and through the respective corner brackets 170.

In the FIGS. 9/12, 13 and 17 embodiments, the various apertures and the plate 121 may be so shaped and dimensioned as to permit rotation of the plate 121 through 90° (or another preferred angle) when one of the retention nuts or bolts is removed. This permits securing of the unitary lengths in a side by side relationship, as shown in FIG. 15*a*, as opposed to the more conventional end to end relationship shown schematically in FIG. 15*b*. Combinations of side to side and end to end abutments may also readily devised, in order to create patterned areas of the unitary lengths joined together.

The coupling assembly shown in FIG. 16 also includes a plate 121, but rather than extending across the joint 127 between the continuous surfaces 111*a* of two adjacent unitary lengths 125,126, the plate 121 extends across the joint 127 on the side edges of the unitary lengths 125,126.

As in the coupling assembly shown in FIG. 17, corner brackets 170 are provided on the corners of each of the unitary lengths. These comer brackets 170 may be secured to the unitary lengths 125,126 by screws or other suitable securing means. Alternatively they may be secured by threaded ends 118 of the elongate rods 117 passing through apertures in the sides of the corner brackets 170.

In FIG. 16 the unitary lengths 125,126 are arranged so that the elongate rods 117 extend along the length of the connected panels, and extend through the sides of the corner brackets 170 on the adjoining faces of the unitary lengths 125,126. A threaded stud 171 is provided on the perpendicular side face of each of the corner brackets 170, so that a threaded stud 171 extends perpendicular to the side of each of the two unitary lengths 125,126 on either side of the joint 127 between them.

A plate 121 can then be positioned across the joint 127 so that the threaded studs 171 on each of the two unitary lengths 125,126 extends through the apertures in the plate 121. The plate 121 is then secured in position by two threaded nuts 172,173 screwed on to the threaded studs 171.

If the unitary lengths are secured together so that the elongate rods 117 extend perpendicular to the length of the connected panels, threaded ends 118 of the elongate rods 117 extend through side walls of the corner brackets 170 on either side of the joint 127 between the two unitary lengths 125,126. So, unlike the assembly shown in FIG. 16, where the elongate rods extend through the side wall of each of the corner brackets 170 on the abutting faces of the unitary lengths 125,126, there is no need for a stud on the other side of the corner brackets 170.

A plate 121 can then be positioned across the joint 127 so that threaded ends 118 of the elongate rods 117 on either side of the joint 127 extend through the apertures in the plate 121. The plate 121 is then secured in position, as before, by two threaded nuts 172,173 screwed on to the threaded ends 118.

In the coupling assembly shown in FIG. 18 two unitary lengths 125,126 are secured together by a bracket 190. The bracket 190 includes a first plate 191 that extends across the joint 127 between the two unitary lengths 125,126 in a similar manner as the plate 121 shown in FIGS. 9, 12, 13 and 17. The first plate 191 includes an aperture at either end, through which threaded bolts or a U-shaped bolt may be used to secure the bracket across the joint 127 The plate 191 includes a downwardly extending portion 192, that in use extends perpendicular from the plate 191, down the sides of the unitary lengths 125,126. From the bottom edge of this downwardly extending portion 192, a second plate 193 extends away from, and in line with the bottom surface of, the unitary lengths 125,126. In use this second plate 193 is in contact with the ground, and a spike 194 can be inserted through an aperture in the second plate 193 to engage in die ground below.

Such a spike 192 discourages the unitary lengths 125,126, and the panels 11 forming them, from moving laterally in use of the panel construction.

Figure 14:
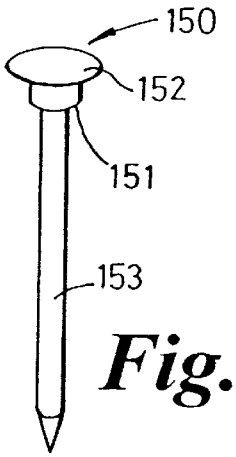
FIG. 14 shows a ground engaging spike.

The unitary lengths 125,126 and the panels 11 forming them can also be discouraged from moving laterally in use of the panel construction by means of spikes 150 shown in FIG. 14.

Each spike 150 may be 300 mm in length and provided with threads at its non-sharpened end 151 so that it can be secured to a panel member 11 having a through going aperture threaded in a complementary fashion. This allows the spikes 150 to protrude from the undersides of the panels 11 in a ground-engaging way, without the risk of the spike heads protruding dangerously above the upper surfaces of the panels.

Each of the coupling assemblies shown in, FIGS. 9, 12, 13 and 16 to 18 ensures that adjacent unitary lengths 125,126 of the panel construction 110 can be coupled together with a minimal gap 111*b* between them. The elongate metal rods 117 and strap member 120 also ensure that the gaps 111*b* between the adjacent panels 111 in each unitary length are also kept to a minimum.

The panels 111 of FIGS. 8 to 12 are preferably extruded from a plastics material such as PVC, including recycled PVC. The lightness of the panels 111 may be further improved by the extruded panels 111 each having formed therein one or more hollow recesses 160.

In other embodiments of the invention, the panels 111 may be extruded from a plastics material such as PVC or recycled PVC, that includes a bulking agent such as wood dust or air bubbles.

When such a bulking agent is used, the panels may be formed as a solid profile, whilst still ensuring that the weight of the panels 111 is kept to a minimum.

When a panel 111 is formed with such a recess 160, the recess 160 is substantially the same as the recess 24 in panel 11 described in connection with the embodiment of FIG. 1.

The panels 111 are formed with a regular or an irregular finish in order to provide a non-slipping finish to the substantially continuous surface 111*a* of the panel construction 110.

The lightness of the panels 11 means that a large number of them can be carried to a site on a conventional trailer, as in the previous embodiment of the invention. The panel construction 110 is created by threading the elongate metal rods 117 through tile panels, applying nuts 119 as required, and securing the strip members 120 to the panels, so defining unitary lengths of the panel construction 110. The completed panels are then lain (quickly) on the ground and connected together or staked in position and subsequently connected to further unitary lengths using one of the arrangements of FIGS. 9, 11 and 12.

What is claimed is:

1. A panel construction comprising:

a plurality of flexible, adjacent panels secured to each other, each panel having a substantially planar configuration comprising two generally parallel surfaces separated by at least one edge surface;

protruding from the at least one edge surface is a projection engageable with a complementary recess in an edge surface of the adjacent panel;

wherein a joint defined by the projection and recess permits the adjacent panels to flex relative to each other, such that the panel construction is flexible as a whole to permit adaptation of the panel construction to contours on which the panel construction rests;

a first set of adjacent panels forming a first unitary length of panels and a second set of adjacent panels forming a second unitary length of panels;

the first unitary length of panels having extending through the entire length a first compression member for securing the first unitary length of panels;

the second unitary length of panels having extending through the entire length a second compression member for securing the second unitary length of panels;

the first and second compression members each passing through the at least one edge surface of the panels and each compression member having at least one end that is threaded for receiving a tensioning nut; and wherein the first unitary length of panels has a coupling device for connecting to a coupling device on the second unitary length of panels.

2. The panel construction according to claim 1 wherein the plurality of adjacent panels have additionally a compression strip extending along at least one side of the two generally parallel surfaces.

3. The panel construction according to claim 2 wherein the compression strip is flexible.

4. The panel construction according to claim 1, wherein the first compression member is rigid.

5. The panel construction according to claim 1, wherein the first compression member is flexible.

6. The panel construction according to claim 1 wherein at least one surface of the two generally parallel surfaces has an uneven finish.

7. The panel construction according to claim 1 wherein at least one surface of the two generally parallel surfaces includes a surface finish.

8. The panel construction according to claim 1 wherein the panels are extruded from a plastics material.

9. The panel construction according to claim 8 wherein the plastics material is recycled PVC.

10. The panel construction according to claim 1 wherein each panel has formed in the at least one edge surface one or more hollow recesses.

11. The panel construction according to claim 10 wherein the one or more hollow recesses extend substantially along a length of the panel.

12. A method for assembling a panel construction comprising the steps of:

securing a plurality of flexible, adjacent panels to each other, each panel having a substantially planar configuration comprising two generally parallel surfaces separated by at least one edge surface;

engaging a projection protruding from the at least one edge surface with a complementary recess in an edge surface of the adjacent panel;

permitting a joint defined by the projection and recess to allow the adjacent panels to flex relative to each other, such that the panel construction is flexible as a whole to permit adaptation of the panel construction to contours on which the panel construction rests;

assembling a first set of adjacent panels into a first unitary length of panels and a second set of adjacent panels into a second unitary length of panels;

inserting a first compression member that extends the entire length of the first unitary length of panels for securing the first unitary length of panels;

inserting a second compression member that extends the entire length of the second unitary length of panels for securing the second unitary length of panels;

wherein the first and second compression members each pass through the at least one edge surface of the panels and each compression member having at least one end that is threaded for receiving a tensioning nut; and placing a coupling device on the first unitary length of panels for connecting to a coupling device on the second unitary length of panels.

* * * * *